US006734398B1

(12) United States Patent
Cecchi

(10) Patent No.: US 6,734,398 B1
(45) Date of Patent: May 11, 2004

(54) BLADDER SYSTEM FOR CONTROLLING THE TEMPERATURE OF LABORATORY FUME HOODS AND WORKING SURFACES

(76) Inventor: Michael D. Cecchi, 339 Bartlett Dr., Madison, CT (US) 06443

( * ) Notice: Subject to any disclaimer, the term of this patent is extended or adjusted under 35 U.S.C. 154(b) by 0 days.

(21) Appl. No.: 10/352,426

(22) Filed: Jan. 29, 2003

(51) Int. Cl.[7] ..... H05B 1/00
(52) U.S. Cl. ..... 219/218; 392/345
(58) Field of Search ..... 219/218, 528, 219/549, 217; 392/345, 471, 470; 604/113

(56) References Cited

U.S. PATENT DOCUMENTS 1,857,087 A * 5/1932 Lindemann ..... 383/110
2,043,327 A * 6/1936 Miller ..... 383/110
2,136,043 A * 11/1938 De Laney ..... 607/114
3,585,356 A * 6/1971 Hall ..... 5/422
4,098,123 A * 7/1978 Granzow, Jr. ..... 374/141
4,159,728 A * 7/1979 Kraus et al. ..... 383/105
4,314,143 A * 2/1982 Bilstad et al. ..... 219/497
4,532,414 A * 7/1985 Shah et al. ..... 392/470
4,591,694 A * 5/1986 Phillips ..... 219/217
4,942,634 A * 7/1990 Saloff et al. ..... 5/682
5,381,510 A * 1/1995 Ford et al. ..... 392/470
5,675,855 A * 10/1997 Culp ..... 5/709
5,875,282 A * 2/1999 Jordan et al. ..... 392/470
6,069,343 A * 5/2000 Kolowich ..... 219/399
6,169,270 B1 * 1/2001 Check ..... 219/387
6,409,748 B1 * 6/2002 DeCarlo et al. ..... 607/114
6,410,893 B1 * 6/2002 Yagnik et al. ..... 219/540
6,497,720 B1 * 12/2002 Augustine et al. ..... 607/96
6,519,835 B1 * 2/2003 Von Arx et al. ..... 29/611
6,566,631 B2 * 5/2003 Faries, Jr. et al. ..... 219/428

* cited by examiner

*Primary Examiner*—Edward K. Look
*Assistant Examiner*—Vinod D. Patel
(74) *Attorney, Agent, or Firm*—William W. Jones

(57) ABSTRACT

A heat transfer bladder system is incorporated into the interior of a laboratory work bench assembly and serves to control the temperature of a work surface of the work bench. The bladder contains a flowable media such as a fluid or gel which is heated or cooled so as to be able to control the temperature of the work bench work surface. The bladder system can include an external temperature control or an internal temperature control to control the temperature of the bladder fluid or gel. The bladder assembly may include through passages for adjunct instruments that can be used in conjunction with the work bench. The bladder can be formed from an elastomeric flexible material, or from a metal such as copper or stainless steel. The temperature control media can be circulated into and out of the bladder, or it can be contained in the bladder.

17 Claims, 4 Drawing Sheets

BLADDER SYSTEM FOR CONTROLLING THE TEMPERATURE OF LABORATORY FUME HOODS AND WORKING SURFACES

TECHNICAL FIELD

This invention relates to a method of heating or cooling the work surface of a laboratory work table and/or a laboratory hood. More particularly, this invention relates to heating of a work surface or hood by the insertion of a bladder system in the hood or the work surface. The use of a bladder system simplifies assembly, reduces labor involved, reduces cost, and also reduces the likelihood of leakage as compared to conventional systems. This invention is also related to the construction of such a bladder system.

BACKGROUND ART

Current laboratory tables and other surfaces are used to maintain a stable heated environment for the placement of specimens such as tissues, embryos and sperm, which require a steady temperature range. One example of this need is studying or working with mammalian cells which require a constant temperature of about 97° F. These cells may be stored in incubators during their growth dormant stages and unused stages. These cells are removed from the incubator and taken to a controlled temperature work bench surface or work station for observation and/or manipulation. The work surface is made of stainless steel due to its anticorrosive nature and ability to maintain an evenly heated surface. Stainless steel is also durable and easy to clean.

The work surfaces are presently heated by one of two mechanisms. One involves the use of electric pads which are adhered to the underside of the work surface. The other involves the use of heated water which is circulated inside of the stainless steel work table structure.

The use of an electrically heated pad below the work surface has several problems in evenly heating the work surface. The electrically heated pads have a series of coils which heat various areas of the work surface and rely on heat sensors and relay systems which are embedded in the pads. The central area of the pads is the area where the heat control is most desirable. The stainless steel work surface has a tendency to lose a great deal of heat at its edges due to the fact that room temperature is less than the desired work surface temperature. Thus the colder edges draw heat away from the central areas of the work surface. This creates a temperature gradient across the work surface. The location of the temperature sensor maintains the desired temperature, but areas of the work surface which are spaced apart from the temperature sensor will have temperatures which may be several degrees lower than the desired temperature. The closer to the edges of the work surface, the lower the temperature.

For example, if the sensor is located in the middle of the pad and work surface, and the desired temperature is 97° F., approximately halfway to the edge of the work surface, the temperature would be 95° F., and at the edge of the work surface, the temperature would be 92° F.

This variation in temperature would be maintained throughout the period of use of the work surface. When the sensor location temperature is reduced to 95° F., which would be the trigger temperature for the temperature regulator to send an electrical surge through the coils to bring the surface temperature back to the desired temperature of 97° F. An example of this is if the temperature of the center of the work table were to drop to 95° F., the temperature of the intermediate areas of the table may drop to 92° F., and the edges may drop to 90° F. In that case, the regulator would send an electrical surge to reheat the pad which would reheat the center by 2° to 95° so as to satisfy the temperature requirements of the center of the pad, and then the regulator would shut off. The middle area of the work surface would also likely get a 2° increase, as would the edges. Therefore, areas of the work surface will be less than the desired temperature throughout the operation of the work surface. Therefore, the aforesaid system is an undesirable manner of heating the work surface in question.

A more desirable solution to the problem is to use a heated fluid system wherein the fluid would be water, a gel, or some other flowable material. Currently employed heated water systems utilize a water pans which are adhered to the undersurface of the work surface. The water is heated with an external heated water bath which circulates water through the pan by means of an external heat pump. The water pan may be secured to the undersurface of the work surface by means on a silicone adhesive or by welding the pan to the undersurface of the work surface. Silicone adhesives are not desirable due to the fact that they will deteriorate and the water in the pan will then leak out of the pan. The welding option also has drawbacks which include scarring of the work surface by the welding temperatures, bowing of the work surface by the welding heat. The seals, whether by adhesives or welds, can also be deteriorated by contact with the heated water being circulated through the water pan. The present solutions to the problem of heating the work surface by means of circulating heated water through a pan attached to the undersurface of the work surface are thus flawed and undesirable.

An additional problem relating to the use of water pans relates to the use of optical instruments such as microscopes to observe the specimens on the work surface. When such optical instruments are used to observed the specimens, it will be necessary to provide light sources to illuminate the specimens, which light sources will be positioned below the work surface and the water pans. Thus, light pipes of some sort must be provided to pass light from the light sources through the water pans and the work surface. The current manner in which light is passed through the water pans, the water, and the work surface is by securing hollow tubes to the water pan and the work surface and passing the tubes through the heated water. Lenses are placed on the work surface at the top of the tubes. The securement of the hollow tubes may be by the use of adhesives or by welding. The same deterioration of the seal problems noted above occur when the heated water directly contacts the sealing adhesives and welds.

It would be desirable to provide a water heated system for controlling the temperature of a laboratory work surface, or other laboratory equipment which eliminates the problems which are incurred when the heating water directly contacts securement joints, such as adhesives or welds in the system.

DISCLOSURE OF THE INVENTION

This invention relates to the construction of a temperature controlled laboratory work surface system which is evenly heated or cooled by a fluid, such as water. The system of this invention utilizes a resilient bladder which is positioned adjacent to the work surface in a temperature transfer relationship with the work surface. The bladder is filled with a circulated heating or cooling fluid, such as water or some other fluid. The use of a bladder prevents the heating or cooling fluid from directly contacting the work surface.

The bladder may be made of pliable heat transfer materials such as rubber, polyvinyl, vinyl, Mylar, and urethanes; or the bladder may be formed from a metal such as copper or stainless steel. The bladder may be a unitary member, or may be composed of a series of interconnected members. A series of interconnected members allows the bladder to conform to several different patterns which may be required in different applications.

A template can be made from metal wiring which is capable of transferring radio wave frequencies (RF) to melt and seal the edges of the bladder or bladders. The template can be constructed so as to conform to the entire shape of the bladder, or it can be configured with different shapes which when sealed together in sequence will allow the bladder to vary in shape and size. One example of a bladder that can be used has a rectangular shape which measures from about twenty inches to about twenty eight inches in depth, and from about twenty four inches to about eighty inches in width. These length and depth dimensions will obviously depend on the size of the work surface being heated or cooled. The bladder can have a thickness which ranges between about one quarter inch to about six inches, again, depending on the size of the work table being heated or cooled. There can be at least one port into the bladder for the insertion of heating or cooling fluids thereinto. Preferably there will be a fluid inlet port and a fluid outlet port RF welded to or adhesively connected to the bladder. The spacing of the ports relative to each other should be such as to result in an even flow of water or air so as to result in an even distribution of the temperature-controlling fluid in the bladder. Variation of the thickness of the bladder material allows control of the bladder flexibility for various uses. The thickness of the bladder material will also determine the temperature transfer characteristics of the bladder when taken in conjunction with the heat transfer characteristics of the bladder material.

The bladder assembly is inserted between the underside of the work surface to be heated or cooled, and a lower bladder support pan on the lab table or work bench. The support pan serves to hold the bladder in place so as to maintain contact between the bladder and the work surface. The support pan also serves to retain the shape of the bladder and to prevent rupturing of the bladder.

Once properly positioned, the bladder can be heated or cooled by several different methods. One method is to use a heated or cooled air stream that is circulated through the bladder.

A second method involves the use of a hot or cold water pressure pump which circulates the temperature controlling water stream through the bladder.

A third method is to install a water-submersible electric coil inside of the bladder in order to heat water which may be circulated through the bladder or which may be sealed within the bladder.

A fourth method is to attach a heat source, such as a heating coil or a heating pad to the outside of the bladder, preferably to the undersurface of the outside of the bladder. The bladder may have a quiescent sealed fluid supply, or it may be provided with a circulating fluid supply. The heating coil or heating pad can heat the fluid from underneath the bladder, and the temperature of the fluid can be controlled by a sensor disposed inside of the bladder or outside of the bladder.

The temperature of the heating coil is preferably regulated by an external regulator which is operatively connected to the temperature sensor.

It is therefore an object of this invention to provide a laboratory table or work bench assembly which has a work surface which is heated or cooled by a fluid that is contained in a bladder which bladder is positioned inside of the table or work bench and is in heat transfer contact with the work surface.

It is another object of this invention to provide an assembly of the character described wherein the temperature-controlling media can be air, water or a flowable gel.

It is an additional object of this invention to provide a system of the character described wherein the temperature-controlling media is water, and the water is heated by a heating coil which is positioned inside or outside of the bladder.

It is another object of this invention to provide a system of the character described wherein the bladder is formed from a resilient material.

BRIEF DESCRIPTION OF THE DRAWINGS

These and other objects and advantages of the invention will become more readily apparent from the following detailed description of an embodiment of the invention, when taken in conjunction with the accompanying drawing in which.

DETAILED DESCRIPTION OF SPECIFIC EMBODIMENTS OF THE INVENTION

Figure 1:
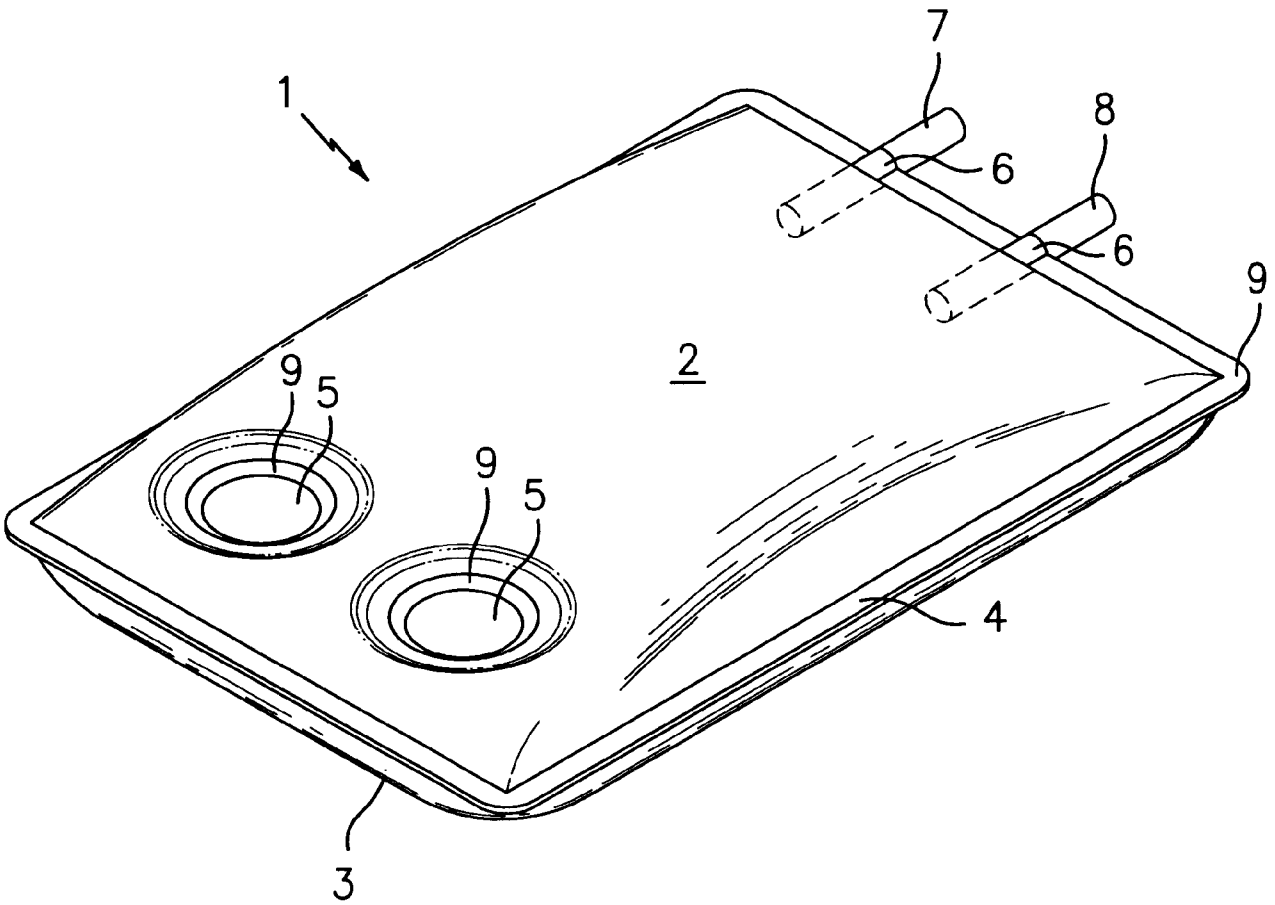
FIG. 1 is a perspective view of a bladder assembly which is formed in accordance with this invention.

Referring now to the drawings, FIG. 1 is a perspective view of a bladder assembly denoted generally by the numeral 1, which bladder assembly 1 is formed in accordance with this invention. The bladder assembly 1 includes a top part 2 and a bottom part 3 which can preferably be made from a vinyl, polyvinyl, urethane, Mylar, or a similar resilient material and which can preferably be RF welded together at edges 4 of the assembly 1. The bladder assembly 1 can also be made from a metal such as copper or stainless steel, as noted above. The bladder assembly 1 has a cavity between the top and bottom parts 2 and 3 which cavity can be filled with a heated or cooled fluid media. The bladder assembly 1 has at least one tube 7 which forms a port into the cavity 1 in the bladder assembly 1. The tube 7 forms a passage through which fluids can be introduced into the cavity in the bladder assembly 1. As shown in FIG. 1, there are preferably two tubes 7 and 8 which form passages with the cavity in the bladder assembly 1 when the fluid media is to be circulated into and out of the bladder cavity. When the fluid media is to remain in the bladder cavity then only a single tube 7 is needed.

The tubes 7 and 8 are preferably secured to the bladder assembly 1 by RF welds 6. The tube 7 can form a fluid inlet port for the bladder assembly 1 and the tube 8 can form a fluid outlet port for the bladder assembly 1. Thus fluids may be pumped into the bladder assembly cavity through the tube 7 and out of the bladder assembly cavity through the tube 8. The bladder assembly 1 can include through passages 5 which extend through the cavity in the bladder assembly 1. The passages 5 are preferably formed by first RF welding the top and bottom parts 2 and 3 of the bladder assembly 1 as noted by the numeral 9. The areas inside of the welds 9 are then cut out to form the passages through the cavity in the bladder assembly 1. The through passages 5 allow the passage of light, or metal parts through the bladder assembly 1 without damaging the bladder assembly 1, or impeding the flow of the heating or cooling fluid therein.

Figure 2:
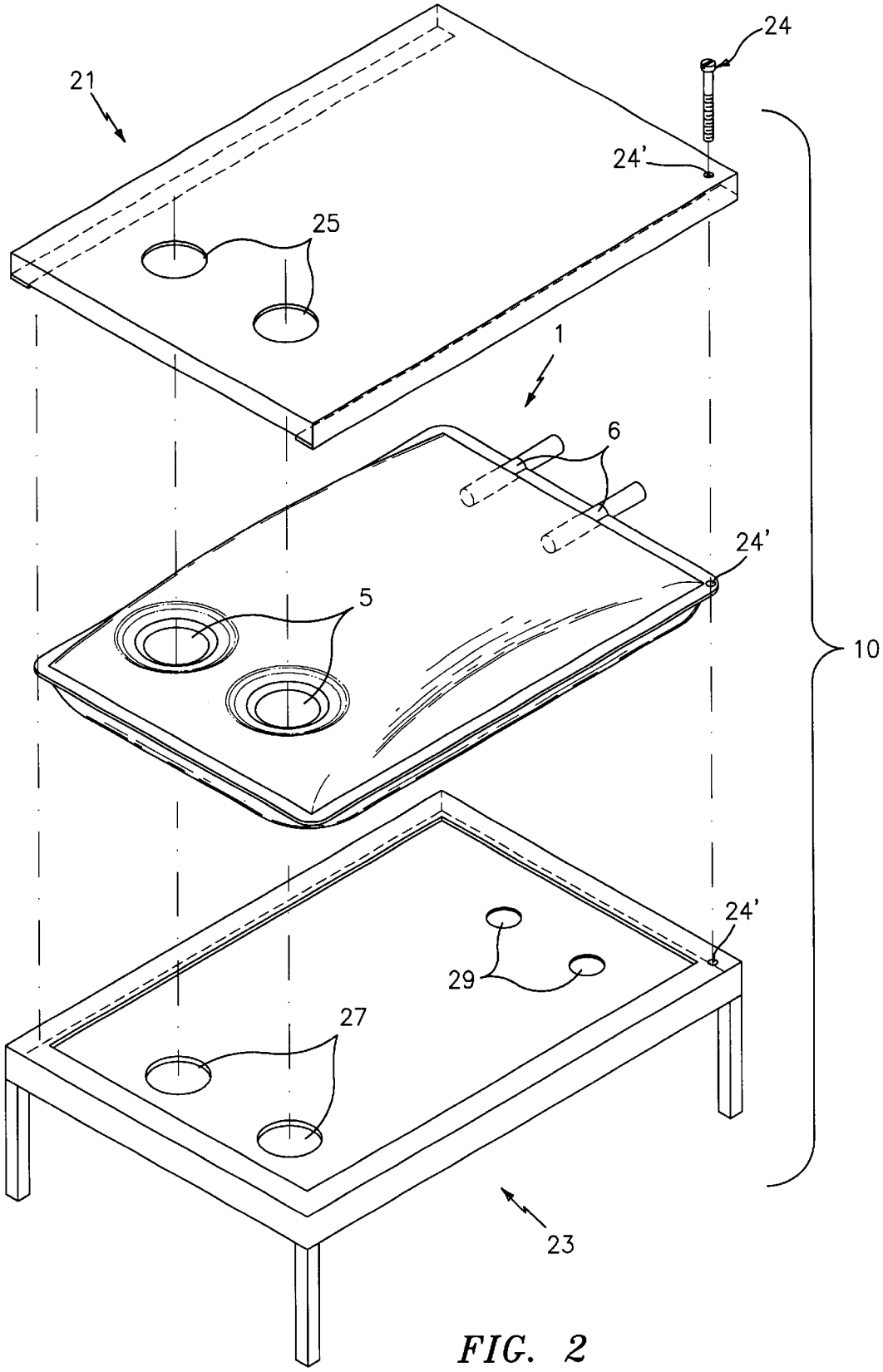
FIG. 2 is an exploded view of a work table assembly which includes the bladder assembly shown in FIG. 1 as a component of the work table assembly.

Referring now to FIG. 2, there is shown the positioning of the bladder assembly 1 inside of the work bench assembly 10. The bladder assembly 1 is disposed between the upper work surface 21 of the table assembly 10 and the lower support pan 23 of the table assembly 10. The support pan 23 is held in place relative to the work surface 21 by means of a plurality of screws, bolts, or other similar removable fasteners 24 (only one shown) which pass through aligned openings 24' in the work surface 21, bladder assembly 1, and support pan 23. During assembly, the through holes 5 in the bladder 1 are aligned with holes 25 in the work surface 21 and holes 27 in the support pan 23 so as to create one or more passages which extend completely through the table assembly 10. The ports 6 can exit the assembly 10 through holes 29 in the support pan 23 so as to allow recirculation of the heating or cooling fluid through the assembly 10.

Figure 3:
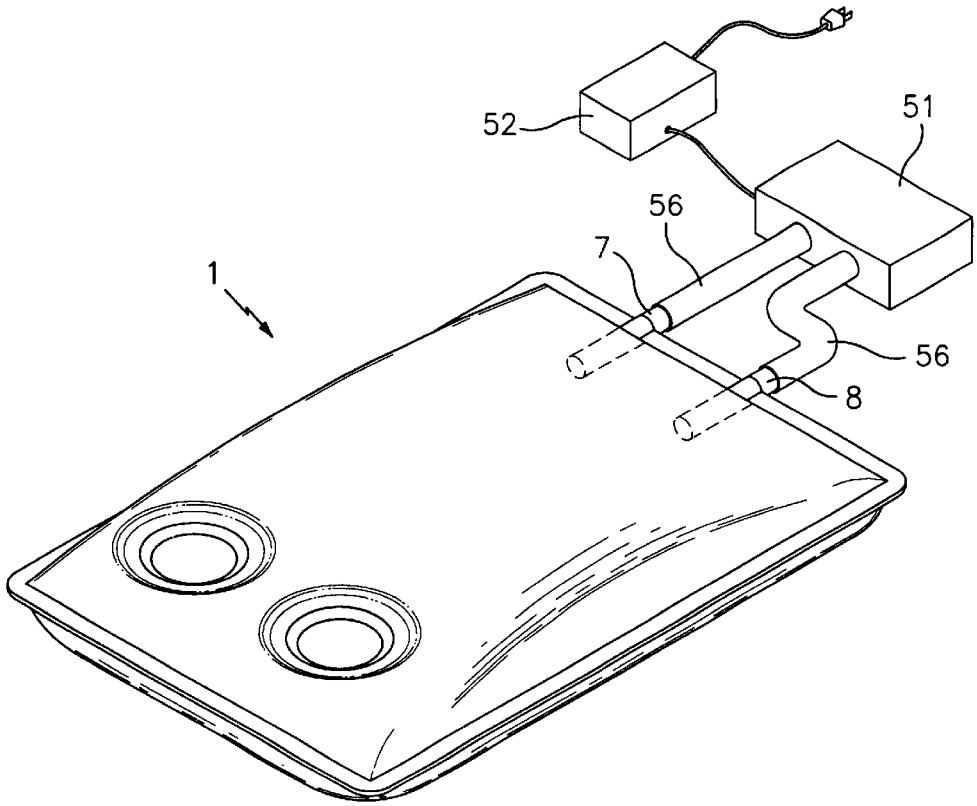
FIG. 3 is a perspective view of a bladder assembly which is formed in accordance with this invention, and which includes an external heating or cooling component that heats or cools the fluid which is circulated through the bladder assembly.

FIG. 3 discloses one manner of heating or cooling the bladder 1 which involves the use of an external heating or coolant pump 51 which creates a stream of hot or cool water, air, or some other fluid media. The temperature of the fluid media in the pump 51 is sensed and controlled by a temperature regulator 52 that is connected to the pump 51. Fluid media circulating inlet and outlet tubes 56 connect the pump 51 with the inlet and outlet tubes 7 and 8 of the bladder 1. When the temperature control fluid media is pumped into the bladder 1, the latter will expand against the undersurface of the work table top in a heat transfer relationship therewith. Flow of the fluid media in question between the bladder 1 and the heat controlled pump 51 maintains the constant desired temperature in the bladder 1 and also maintains the bladder 1 in heat exchange relationship with the work table top work surface.

Figure 4:
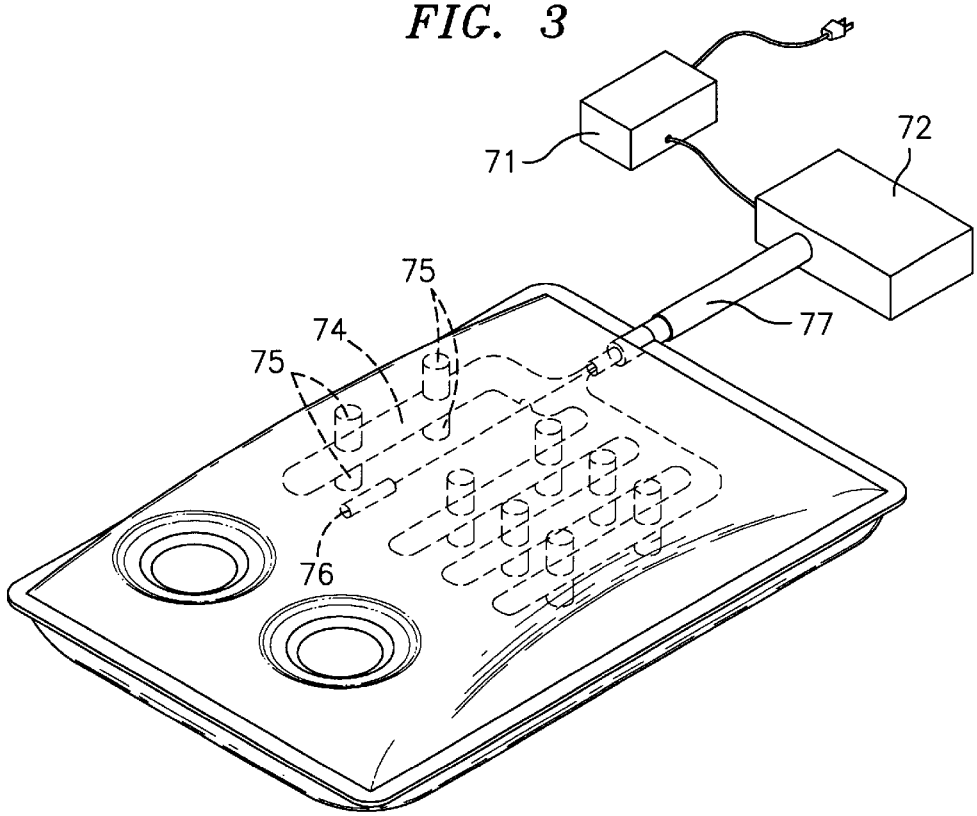
FIG. 4 is a perspective view of a bladder assembly which is formed in accordance with this invention, and which includes an internal heating or cooling component that heats or cools the media that resides in, or is circulated through the bladder assembly.

FIG. 4 discloses an embodiment of the bladder assembly 1 wherein an internal electrical heating coil 74 provides heat to the fluid media being circulated through the bladder 1. The coil 74 is connected to an external power supply 71 that provides power to an external temperature regulator 72 so as to provide the proper current to the coil 74. The heating coil 74 is formed from an electrically conductive resistance wire. The coil 74 is preferably separated from the upper and lower layers of the bladder 1 by electrical insulators 75 which are spaced along the coil 74 so as to prevent puncturing of the bladder 1 by the coil 74. The heating coil 74 is permanently inserted into the bladder 1 through a port 77. The bladder 1 can be filled with a heatable fluid media, such as water, or a gel. The temperature regulator 72 is connected to a temperature sensor 76 that is immersed in the fluid media in the bladder 1. The temperature sensor 76 signals the regulator 72 as to the temperature of the fluid media in the bladder 1 so that the temperature can be adjusted to the desired temperature range.

Figure 5:
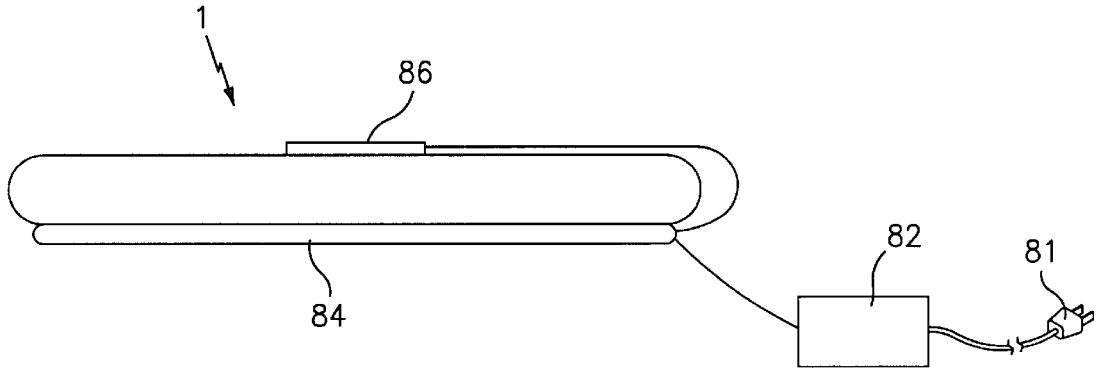
FIG. 5 is a side elevational view of bladder assembly which is formed in accordance with this invention wherein the contents of the bladder are heated from the outside by an external heat source.

FIG. 5 shows an embodiment of the bladder assembly 1 wherein an external electrical heating coil 84 provides heat to the fluid media being circulated through the bladder 1. The coil 74 is connected to an external power supply 81 that provides power to an external temperature regulator 82 so as to provide the proper current to the coil 84. The heating coil 84 is formed from an electrically conductive resistance wire. The coil 84 is preferably attached to the lower layer of the bladder 1. The bladder 1 can be filled with a heatable fluid media, such as water, or a gel. The temperature regulator 82 is connected to a temperature sensor 86 that is positioned on the upper surface of the bladder 1. The temperature sensor 86 signals the regulator 82 as to the temperature of the fluid media in the bladder 1 so that the temperature can be adjusted to the desired temperature range.

It will be readily appreciated that the system of this invention will provide a less expensive and relatively simple format for controlling the temperature of the work surface of a laboratory work bench. The use of a bladder for harnessing a temperature-dictating fluid or gel allows the provision of through passages for adjunct instruments, and provides an even distribution of heat or cooling to the work surface of the laboratory bench. The cooling of the work surface will be used when the specimens being placed on the work surface are issue specimens that have been stored in a refrigerator, and their temperature should be kept at refrigerator temperatures while they are on the work surface.

Since many changes and variations of the disclosed embodiments of the invention may be made without departing from the inventive concept, it is not intended to limit the invention otherwise than as required by the appended claims.

What is claimed is:

1. An assembly for controlling the temperature of a work surface on a laboratory work table, said assembly comprising:

a) a resilient bladder for underlying said work surface, said bladder being operative to be disposed in heat transfer relationship with essentially the entirety of an undersurface of said work surface;

b) a heat transfer material inside of said bladder, said heat transfer material having a temperature which controls the temperature of said work surface; and c) means for maintaining the temperature of said heat transfer material within a given range of temperatures.

2. The assembly of claim 1 wherein said heat transfer material is a fluid.

3. The assembly of claim 2 wherein said bladder has an inlet port and an outlet port whereby said fluid can be circulated through said bladder.

4. The assembly of claim 1 wherein said means for maintaining the heat transfer material temperature is a heater.

5. The assembly of claim 4 wherein the said heater is controlled by a temperature sensor that is operative to sense the temperature of said heat transfer material.

6. The assembly of claim 4 wherein said heater is disposed adjacent to an outer surface of said bladder.

7. The assembly of claim 1 wherein said bladder has at least one through plane opening to acoomodate an adjunct instrument that is associated with the work surface.

8. The assembly of claim 1 wherein said heat transfer material is a gel.

9. The assembly of claim 1 wherein said bladder has at least one port for filling the interior of said bladder with said heat transfer material.

10. A laboratory work table assembly comprising:

a) a work surface for supporting laboratory specimens;

b) a bladder underlying said work surface, said bladder being disposed in heat transfer relationship with essentially the entirety of an undersurface of said work surface;

c) a heat transfer material inside of said bladder, said heat transfer material having a temperature which controls the temperature of said work surface;

d) means for maintaining the temperature of said heat transfer material within a given range of temperatures; and e) a support member which is operative to support the weight of said bladder and prevent said bladder from altering its heat transfer relationship with the undersurface of said work surface.

11. The assembly of claim 10 wherein said heat transfer material is a fluid.

12. The assembly of claim 11 wherein said bladder has an inlet port and an outlet port whereby said fluid can be circulated through said bladder.

13. The assembly of claim 10 wherein said means for maintaining the heat transfer material temperature is a heater.

14. The assembly of claim 13 wherein the said heater is controlled by a temperature sensor that is operative to sense the temperature of said heat transfer material.

15. The assembly of claim 10 wherein said bladder and table have at least one through plane opening to accomodate an adjunct instrument that is associated with the work surface.

16. The assembly of claim 10 wherein said heat transfer material is a gel.

17. An assembly for controlling the temperature of a work surface on a laboratory work table, said assembly comprising:

a) a bladder for underlying said work surface, said bladder being operative to be disposed in heat transfer relationship with essentially the entirety of an undersurface of said work surface;

b) a heat transfer material sealed inside of said bladder, said heat transfer material having a temperature which controls the temperature of said work surface; and c) means for maintaining the temperature of said heat transfer material within a given range of temperatures.

* * * * *